US007326167B2

(12) United States Patent
Suzuki et al.

(10) Patent No.: US 7,326,167 B2
(45) Date of Patent: Feb. 5, 2008

(54) SHEET FOLDING DEVICE

(75) Inventors: Nobuyoshi Suzuki, Tokyo (JP); Masahiro Tamura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 308 days.

(21) Appl. No.: 10/864,466

(22) Filed: Jun. 10, 2004

(65) Prior Publication Data

US 2004/0254054 A1 Dec. 16, 2004

(30) Foreign Application Priority Data

Jun. 12, 2003 (JP) ..... 2003-168395

(51) Int. Cl.
*B31F 1/10* (2006.01)

(52) U.S. Cl. ..... 493/444; 493/434; 493/442; 493/405

(58) Field of Classification Search ..... 493/405, 493/434, 435–437, 442, 444, 454
See application file for complete search history.

(56) References Cited

U.S. PATENT DOCUMENTS

| | | | | |
|---|---|---|---|---|
| 3,901,501 | A * | 8/1975 | Kistner | 493/444 |
| 5,692,411 | A | 12/1997 | Tamura | |
| 6,145,825 | A | 11/2000 | Kunihiro et al. | |
| 6,199,853 | B1 | 3/2001 | Andoh et al. | |
| 6,264,191 | B1 | 7/2001 | Suzuki et al. | |
| 6,296,247 | B1 | 10/2001 | Tamura et al. | |
| 6,394,448 | B2 | 5/2002 | Suzuki et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,549,734 | B2 | 4/2003 | Yamada et al. | |
| 6,568,668 | B1 | 5/2003 | Wakabayashi et al. | |
| 6,674,035 | B2 * | 1/2004 | Ito | 209/563 |
| 6,698,744 | B2 | 3/2004 | Yamada et al. | |
| 6,783,124 | B2 | 8/2004 | Tamura et al. | |
| 6,837,840 | B2 * | 1/2005 | Yonekawa et al. | 493/444 |
| 6,939,283 | B2 * | 9/2005 | Sparano et al. | 493/424 |
| 2004/0254054 | A1 | 12/2004 | Suzuki et al. | |

FOREIGN PATENT DOCUMENTS

EP 2002-145516 5/2002

(Continued)

OTHER PUBLICATIONS

U.S. Appl. No. 09/997,304, filed Nov. 30, 2001, Tamura et al.

(Continued)

*Primary Examiner*—Hemant M. Desai
(74) *Attorney, Agent, or Firm*—Oblon, Spivak, McClelland, Maier & Neustadt, P.C.

(57) ABSTRACT

A sheet folding device includes a folding plate configured to push out a sheet or sheet stack in a direction pre-set against a conveying path; a couple of folding rollers configured to push the sheet being pushed into a nip of the folding roller couple; and a guide part configured to guide the sheet or the sheet stack so as to prevent the sheet from coming contact in with the folding rollers in the conveying path where the sheet or the sheet stack is conveyed. The sheet or the sheet stack is folded while being put between and conveyed by the couple of the folding rollers.

10 Claims, 15 Drawing Sheets

FOREIGN PATENT DOCUMENTS

| | | | |
|---|---|---|---|
| EP | 1 568 637 A1 | | 8/2005 |
| JP | 61-197369 | | 9/1986 |
| JP | 61-217476 | | 9/1986 |
| JP | 05-165356 | | 7/1993 |
| JP | 11-079545 | * | 3/1999 |
| JP | 2000-143088 | | 5/2000 |
| JP | 2001-2317 | | 1/2001 |
| JP | 2001-72328 | | 3/2001 |
| JP | 2003-095506 | | 3/2003 |
| JP | 2004-059304 | * | 2/2004 |

OTHER PUBLICATIONS

U.S. Appl. No. 10/015,634, filed Dec. 17, 2001, Tamura et al.
U.S. Appl. No. 10/101,741, filed Mar. 21, 2002, Suzuki et al.
U.S. Appl. No. 10/109,992, filed Apr. 1, 2002, Nagasako et al.
U.S. Appl. No. 10/172,910, filed Jun. 18, 2002, Tamura et al.
U.S. Appl. No. 10/253,652, filed Sep. 25, 2002, Yamada et al.
U.S. Appl. No. 10/339,304, filed Jan. 10, 2003, Suzuki et al.
U.S. Appl. No. 10/361,762, filed Feb. 11, 2003, Yamada et al.
U.S. Appl. No. 10/385,489, filed Mar. 12, 2003, Tamura et al.
U.S. Appl. No. 10/395,053, filed Mar. 25, 2003, Yamada et al.
U.S. Appl. No. 10/443,028, filed May 22, 2003, Tamura et al.
U.S. Appl. No. 10/629,654, filed Jul. 30, 2003, Yamada et al.
U.S. Appl. No. 10/640,044, filed Aug. 14, 2003, Suzuki et al.
U.S. Appl. No. 10/864,466, filed Jun. 10, 2004, Suzuki et al.
U.S. Appl. No. 11/267,403, filed Nov. 7, 2005, Tokita et al.
U.S. Appl. No. 11/273,301, filed Nov. 15, 2005, Iida et al.
U.S. Appl. No. 11/254,868, filed Oct. 21, 2005, Suzuki et al.
U.S. Appl. No. 11/223,052, filed Sep. 12, 2005, Suzuki et al.
U.S. Appl. No. 11/130,118, filed May 17, 2005, Suzuki et al.
U.S. Appl. No. 11/080,923, filed Mar. 16, 2005, Tamura et al.

* cited by examiner

SHEET FOLDING DEVICE

BACKGROUND OF THE INVENTION

1. Field of the Invention

The present invention generally relates to (1) sheet folding devices whereby a sheet stack is accumulated, arranged, and folded; (2) sheet processors which are provided to image forming devices, such as copiers, printers, or printing machines, in a body or separately, and whereby predetermined processes such as classification processes, stacking processes, binding processes, and center-binding bookbinding processes are performed on the sheets (recording media) where the images are formed so that the sheets are discharged; and (3) image forming systems having the sheet processors and the image forming devices.

2. Description of the Related Art

There is extensively used a post-treatment device arranged at the downstream side of an image outputting device, such as a copier or printer, for, e.g., binding sheets driven out of the image forming apparatus. Today, even a post-treatment device with multiple advanced functions including an edge function and a center binding function is available. In addition, recently it is desired for the device to accomplish space-saving, cost-saving, and high productivity.

Conventionally, in this kind of sheet post-treatment device, the following method is applied as a method for folding for center binding bookbinding. That is, the center of the sheet stack is bound and the sheet stack is passed to a side of a folding roller couple exposed to a conveying path. The sheet stack is positioned and piled up at a folding position. A binding part of the sheet stack is pushed in a substantially perpendicular direction by a folding plate. The sheet stack is passed through the folding roller couple provided in a moving direction of the sheet stack so that the sheet stack is folded at the center. At this time, when a head end of the sheet stack passes the side of the folding roller couple exposed to a conveying path, the sheet stack comes in contact with the folding roller so that the end of the sheet may become folded and a jammed paper condition may occur. In order to avoid this, various methods are applied. For example, the folding roller is positioned to be greatly separated from the path or covered with sheet metal.

However, according to the above mentioned method, the distance between the nip position of the folding rollers and the folding plate, being out at a side of a direction facing the path, is long. Because of this, the moving distance of the folding plate increases and therefore a space for arranging a driving part of the folding plate becomes large and a large space is required. Furthermore, since the time for moving the folding plate increases, not only does the device size become large but also productivity of the machine becomes low. In order to solve this problem, there is an invention disclosed in Japanese Laid-Open Patent Application No. 2001-72328.

In this related art, while the folding roller is covered during time that the sheet stack is conveyed, the sheet stack is guided by a certain mechanism. Also, when the sheet stack is folded, the mechanism is moved out so that the folding roller is exposed.

However, in the above mentioned related art, although a small space may be required, the mechanism for moving out is required and so that the cost increases.

SUMMARY OF THE INVENTION

Accordingly, it is a general object of the present invention to provide a novel and useful sheet folding device, sheet processor having the same, and image forming system in which one or more of the problems described above are eliminated.

More specifically, the object of the present invention is to provide a sheet folding device, sheet processor having the same, and image forming system which can process with space-saving, low cost and high productivity.

The above object of the present invention is achieved by a sheet folding device, including:

a folding plate configured to push out a sheet or sheet stack in a direction pre-set against a conveying path;

a couple of folding rollers configured to push the sheet being pushed into a nip of the folding roller couple; and a guide part configured to guide the sheet or the sheet stack so as to prevent the sheet from coming contact in with the folding rollers in the conveying path where the sheet or the sheet stack is conveyed;

wherein the sheet or the sheet stack is folded while being put between and conveyed by the couple of the folding rollers.

The guide part may be formed by a first guide member and a second guide member, and each of the guide members may be made of a member having elasticity whose property is different from each other.

The first guide member may be provided at a upper stream side against the conveying path, the second guide member may be provided at a down stream side against the conveying path, and a free end of the first guide member may project into a side of the conveying path more than a free end of the second guide member projects.

The free end of the second guide member may conform to an external configuration at a side of the corresponding folding roller.

The first guide member may be made of a material softer than a material of which the second guide member is made.

Free ends of the first guide member and the second guide member may be positioned so as to prevent pressure-welding by the folding rollers, which corresponds to a stiffness force of the sheet or the sheet stack, at the time when the sheet or the sheet stack is pushed into the nip of the folding rollers by the folding plate.

The guide part may be formed by a first guide member and a second guide member, and at least one of the first and second guide members may be changed in a body with the corresponding folding roller.

The folding rollers may be moved corresponding to entry into the nip of the sheet stack.

The folding rollers may be made of a material of which a coefficient of friction against a material having a good smoothness is lower than a coefficient of friction against the sheet.

The above object of the present invention is also achieved by a sheet processor, including:

a sheet folding device which includes a folding plate configured to push out a sheet or sheet stack in a direction pre-set against a conveying path;

a couple of folding rollers configured to push the sheet being pushed into a nip of the folding roller couple; and a guide part configured to guide the sheet or the sheet stack so as to prevent the sheet from coming in contact with the folding rollers in the conveying path where the sheet or the sheet stack is conveyed;

wherein the sheet or the sheet stack is folded while being put between and conveyed by the folding rollers; and a process part configured to applying a designated process to the sheet.

The above object of the present invention is also achieved by an image forming system, including:

a image forming means for forming an image on a recording medium; and a sheet processor having a sheet folding device which includes a folding plate configured to push out a sheet or sheet stack in a direction pre-set against a conveying path;

a couple of folding rollers configured to push the sheet being pushed into a nip of the folding roller couple; and a guide part configured to guide the sheet or the sheet stack so as to prevent the sheet from coming in contact with the folding rollers in the conveying path where the sheet or the sheet stack is conveyed;

wherein the sheet or the sheet stack is folded while being put between and conveyed by the folding rollers; and a process part configured to applying a designated process to the sheet.

In the following embodiment, a path in a perpendicular direction which is formed by a lower guide plate 91 and an upper guide plate 92 represents an example of the sheet conveying path of the present invention.

Other objects, features, and advantages of the present invention will become more apparent from the following detailed description when read in conjunction with the accompanying drawings.

DETAILED DESCRIPTION OF THE PREFERRED EMBODIMENTS

A description is next given, with reference to FIG. 1 through FIG. 16, of embodiments of the present invention.

1. Mechanical Structure

1.1 Whole Structure

Figure 1:
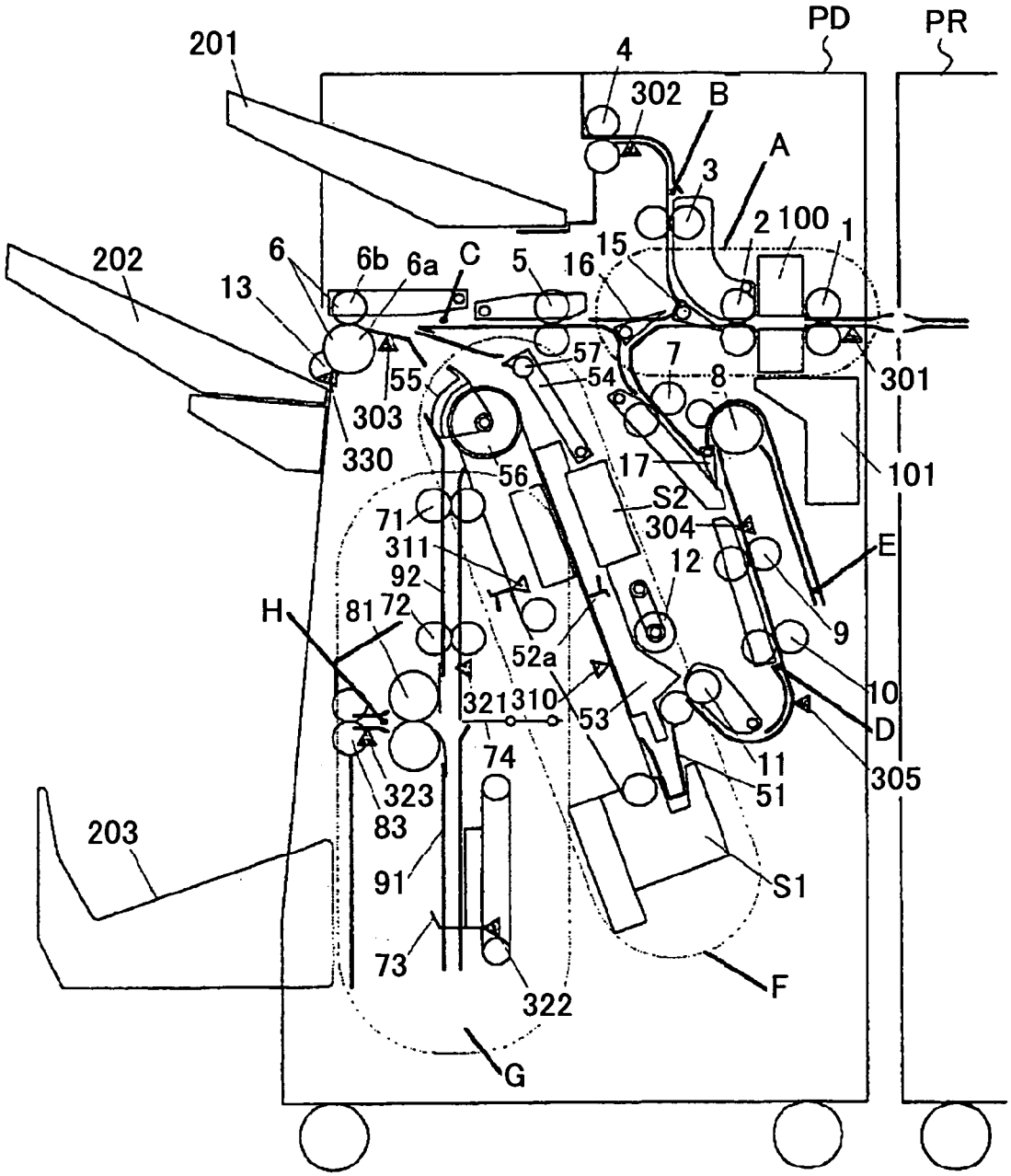
FIG. 1 is a view showing a system structure of an image forming system, formed by a post-treatment device PD as a sheet processor of an embodiment of the present invention and an image forming device PR.

FIG. 1 shows a system structure of an image forming system, formed by a post-treatment device PD as a sheet processor of an embodiment of the present invention and an image forming device PR. More specifically, FIG. 1 shows the whole of the sheet post-treatment device and a part of the image forming device.

Referring to FIG. 1, the post-treatment device PD is operatively connected to one side of the image forming device PR. A sheet or recording medium driven out of the image forming device PR is introduced into the post-treatment device PD. The sheet is then conveyed through a path A where post-processing means for post-processing a single sheet is located. In the illustrative embodiment, the post-processing means on the path A is implemented as a punch unit or punching means 100. Subsequently, the sheet is steered by a path selector 15 to either one of a path B terminating at an upper tray 201 and a path C terminating at a shift tray 202 or steered by a path selector 16 to a path terminating at a processing tray F. The processing tray F is used to position, staple or otherwise process a sheet or sheets, and in this sense is referred to as a staple tray hereinafter.

Sheets sequentially brought to the staple tray F via the paths A and D are positioned one by one, stapled or otherwise processed by the staple process tray F, and then steered by a guide plate 54 and a movable guide 55 to either one of the path C and another processing tray G. The processing tray G folds or otherwise processes the sheets, and in this sense is referred to as a fold tray hereinafter. The sheets folded by the fold tray G are guided to a lower tray 203 via the path H. The path D includes a path selector 17 constantly urged to the position shown in FIG. 1 by a light-load spring not shown. An arrangement is made such that after the trailing edge of a sheet has moved away from the path selector 17, among conveying rollers 9 and 10 and a staple discharge roller 11, at least the conveying roller 9 is rotated in the reverse direction to convey the trailing edge of the sheet to a sheet receiving portion E by a pre-stack roller 8 and cause the sheet to stay there. In this case, the sheet can be conveyed together with the next sheet superposed thereon. Such an operation may be repeated to convey two or more sheets together.

On the path A feeding into the paths B, C and D, there are sequentially arranged an inlet sensor 301 responsive to a sheet coming into the post-treatment device PD, an inlet roller pair 1, the punch unit 100, a hopper 101 for storing scraps, a conveying roller pair 2, and path selectors 15 and 16. Springs, not shown, constantly urge the path selectors 15 and 16 to the positions shown in FIG. 1. When solenoids, not shown, are energized, the path selectors 15 and 16 rotate upward and downward, respectively, to thereby steer the sheet to the desired one of the paths B, C and D.

More specifically, to guide a sheet to the path B, the path selector 15 is held in the position shown in FIG. 1 while the solenoid assigned thereto is turned off. To guide a sheet to the path C, the solenoids are turned on to rotate the path selectors 15 and 16 upward and downward, respectively. Further, to guide a sheet to the path D, the path selector 16 is held in the position shown in FIG. 1 while the solenoid assigned thereto is turned off; at the same time, the solenoid assigned to the path selector 15 is turned on to move it angularly upward.

In the illustrative embodiment, the post-treatment device PD is capable of selectively effecting punching (punch unit 100), jogging and edge binding (jogger fence 53 and edge binding stapler S1), jogging and center binding (jogger fence 53 and center binding staplers S2), sorting (shift tray 202) and center folding (fold plate 74 and fold roller 81).

1.2 Process Mechanism

Figure 2:
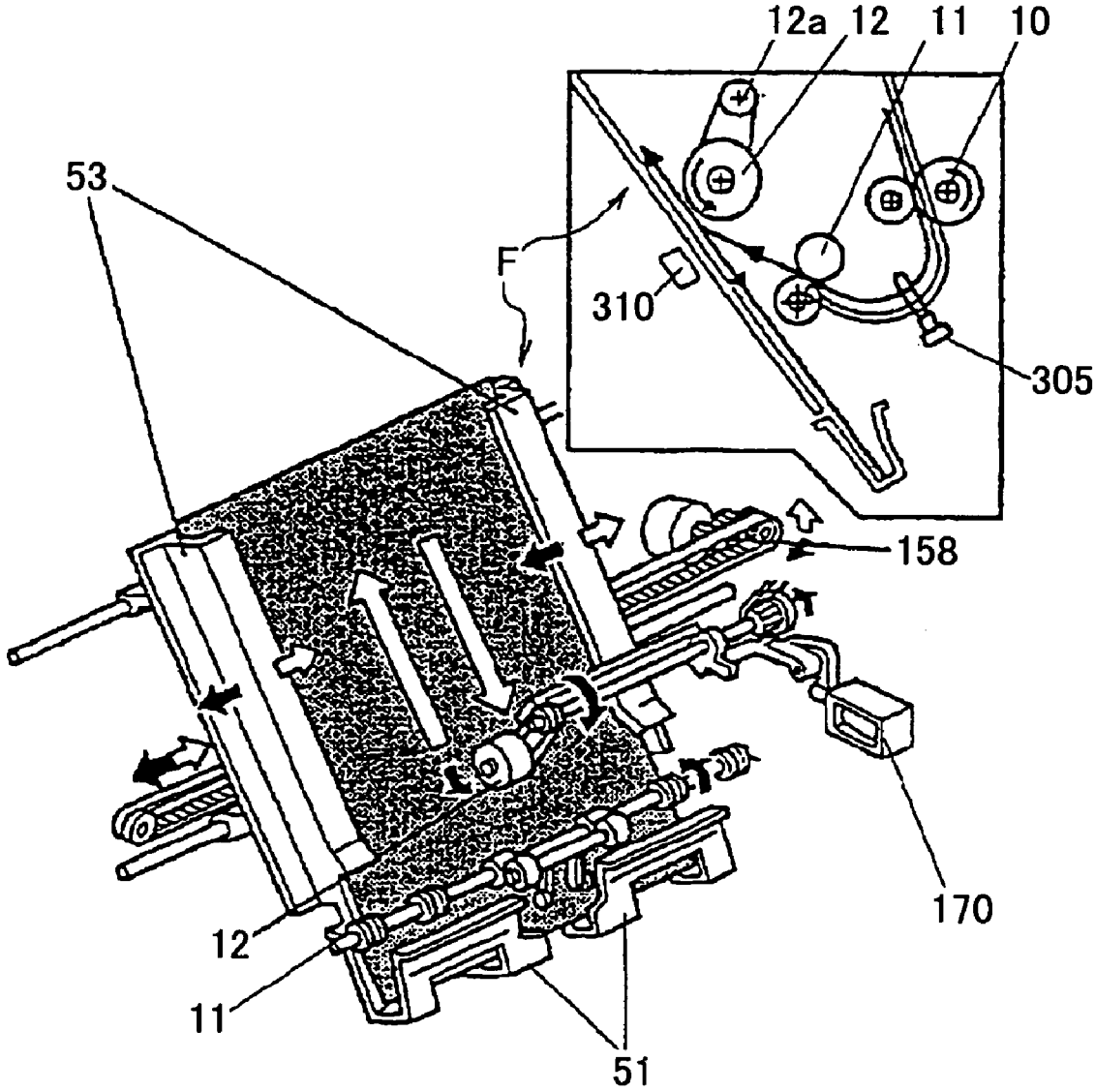
FIG. 2 is an isometric view showing the staple process tray of the sheet post-treatment device PD and a mechanism for driving it.

As shown in FIG. 2, a solenoid 170 causes the knock roller 12 to move about a fulcrum 12*a* in a pendulum fashion, so that the knock roller 12 intermittently acts on sheets sequentially driven to the staple process tray F and causes their trailing edges to abut against rear fences 51. The knock roller 12 rotates counterclockwise about its axis.

A reversible jogger motor 158 drives the jogger fences 53 via a timing belt and causes them to move back and forth in the direction of sheet width.

A reversible stapler motor causes the edge binding stapler S1 to move in the direction of sheet width via a timing belt so as to bind a sheet stack at a pre-selected edge position. A stapler HP sensor is positioned at one side of the movable range of the edge stapler S1 in order to sense the edge stapler S1 brought to its home position. The binding position in the direction of sheet width is controlled in terms of the displacement of the edge binding stapler S1 from the home position. The edge binding stapler S1 is capable of selectively driving a staple into a sheet stack parallel to or obliquely relative to the edge of the sheet stack. Furthermore, at the home position, only the binding mechanism portion of the edge binding stapler S1 is rotated by a pre-selected angle for the replacement of staples.

As shown in FIG. 1, a pair of center binding staplers S2 are affixed to a stay 63 and are located at a position where the distance between the rear fences 51 and their stapling positions is equal to or greater than one-half of the length of the maximum sheet size, as measured in the direction of conveyance, that can be stapled. The center binding staplers S2 are symmetrical to each other with respect to the center in the direction of sheet width. The center binding staplers S2 themselves are conventional and are not be described specifically herein. Briefly, after a sheet stack has been fully positioned by the jogger fences 53, rear fences 51 and knock rollers 5, the discharge belt 52 lifts the trailing edge of the sheet stack with its hook 52*a* to a position where the center of the sheet stack in the direction of sheet conveyance coincides with the stapling positions of the center binding staplers S2. The center binding staplers S2 are then driven to staple the sheet stack. The stapled sheet stack is conveyed to the fold tray G and folded at the center, as is described in detail below.

There are also shown in FIGS. 1 and 2 a sensor 310 responsive to the presence/absence of a sheet stack on the staple tray F and a staple discharge sensor 305.

1.3 Mechanism for Steering a Sheet Stack

To allow the sheet stack stapled by the center staplers S2 to be folded at the center on the fold tray G, sheet steering means is located at the most downstream side of the staple process tray F in the direction of sheet conveyance in order to steer the stapled sheet stack toward the fold tray G.

Figure 3:
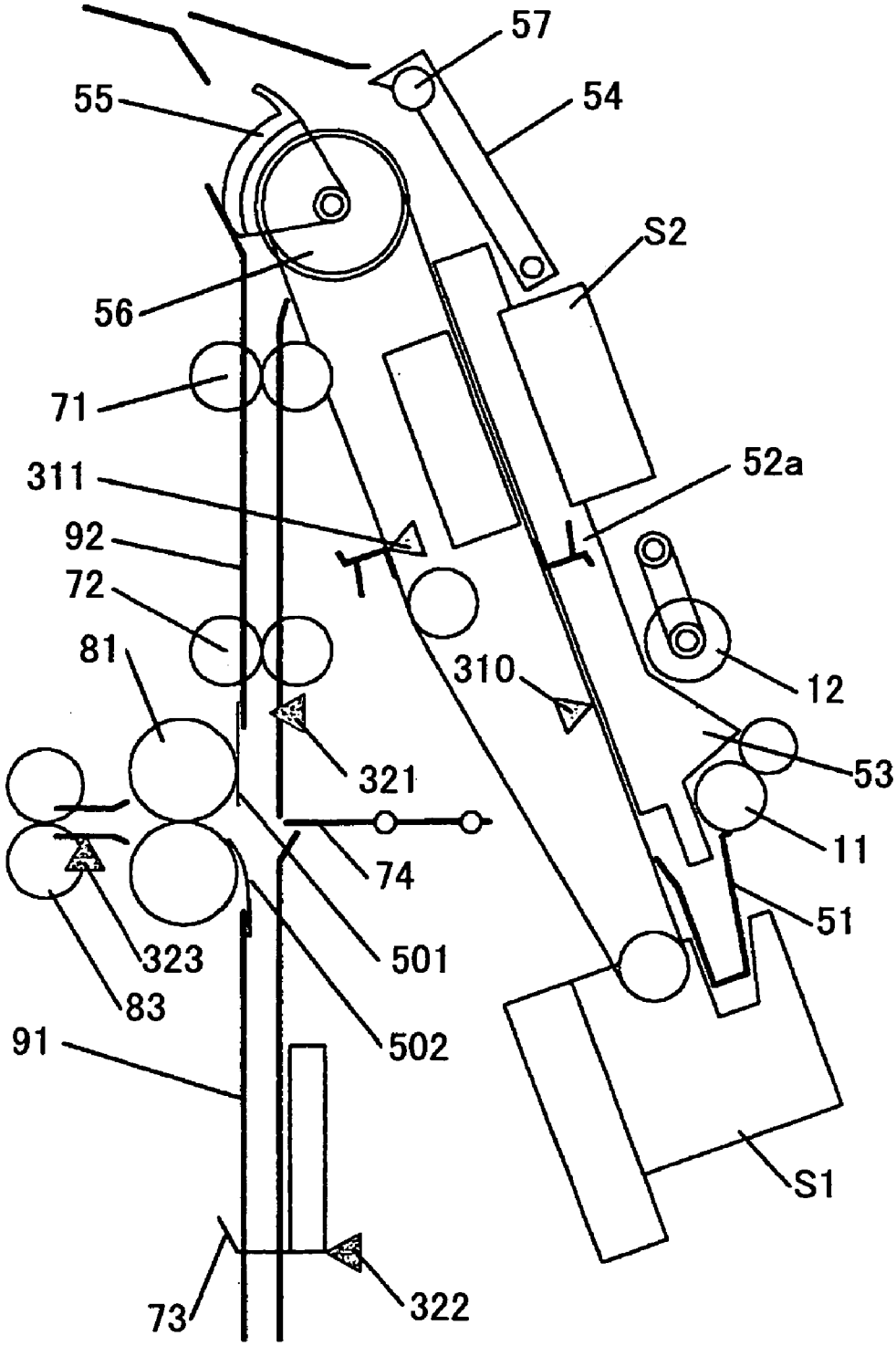
FIG. 3 is a view showing the staple process tray of the sheet post-treatment device and a center fold tray in detail.

As best shown in FIG. 3, which is an enlarged view of the staple process tray F and fold tray G, the sheet steering mechanism includes the guide plate 54 and movable guide 55. The guide plate 54 is angularly movable about a fulcrum in the up-and-down direction and supports the press roller 57, which is freely rotatable, on its downstream end. A spring constantly urges the guide plate 54 toward the discharge roller 56. The guide plate 54 is held in contact with the cam surface of a cam, which is driven by a steer motor (not shown). The movable guide 55 is angularly movably mounted on the shaft of the discharge roller 56.

1.4 Fold Tray

The fold plate 74 is provided so as to move back and forth perpendicularly to a lower guide plate 91 and an upper guide plate 92 shown in FIG. 1. When the fold cam is rotated, the fold plate 74 is moved and enters the sheet stack storing range of the fold tray G. When the fold plate cam is rotated in a reverse direction, the fold plate 74 retracts so as to move out of the sheet stack storing range.

2. Control System

Figure 4:
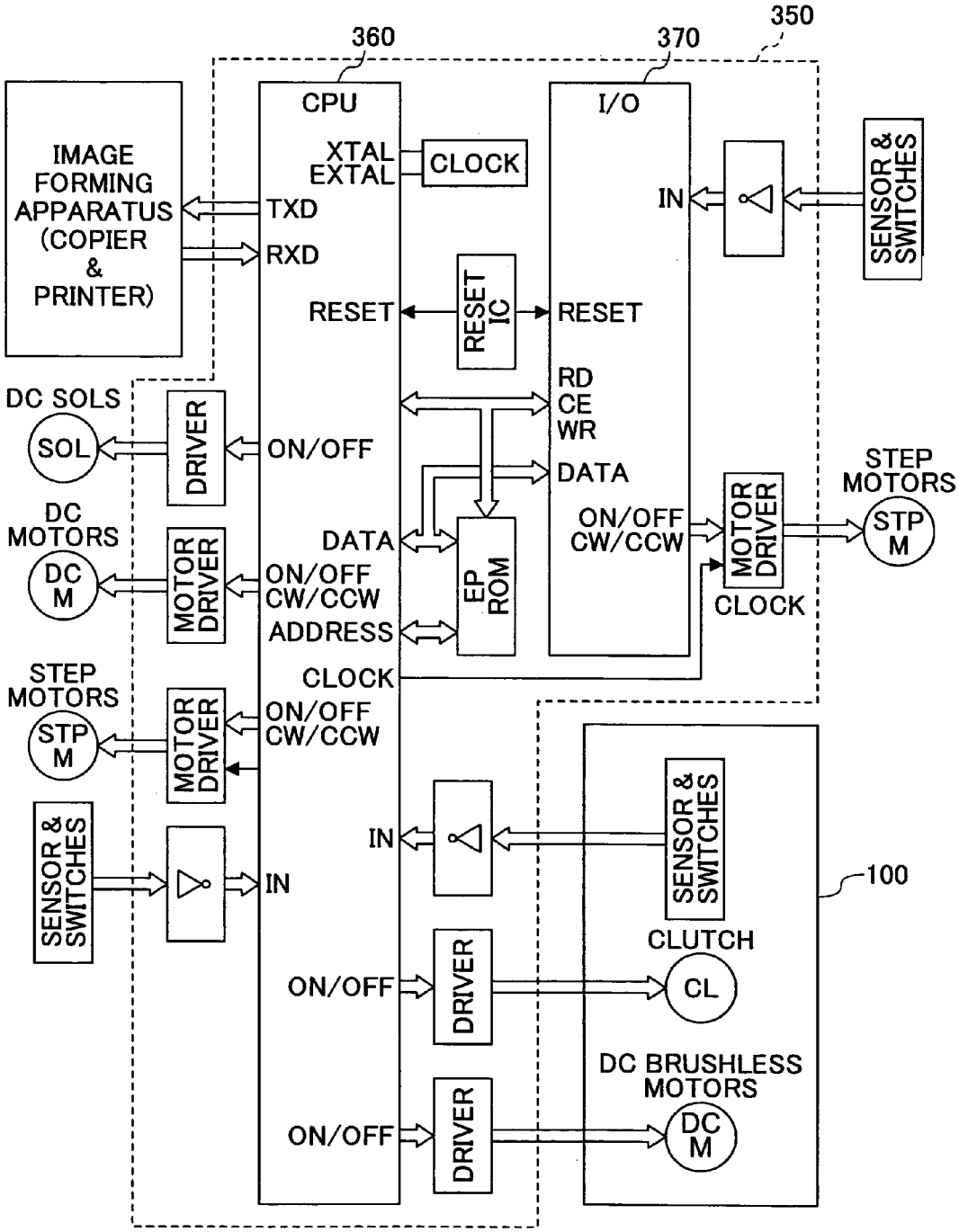
FIG. 4 is a diagram of a control circuit of the sheet post-treatment device and the image forming device.
Figure 5:
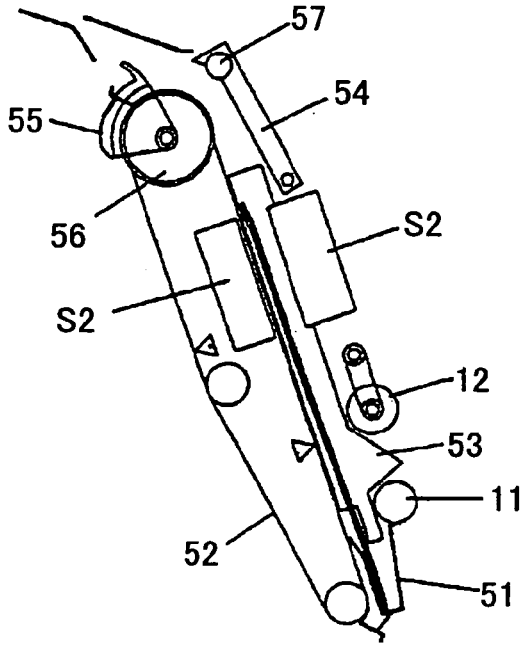
FIG. 5 is a view showing a state of a sheet stack which is stacked at the staple process tray in a center binding bookbinding mode.
Figure 6:
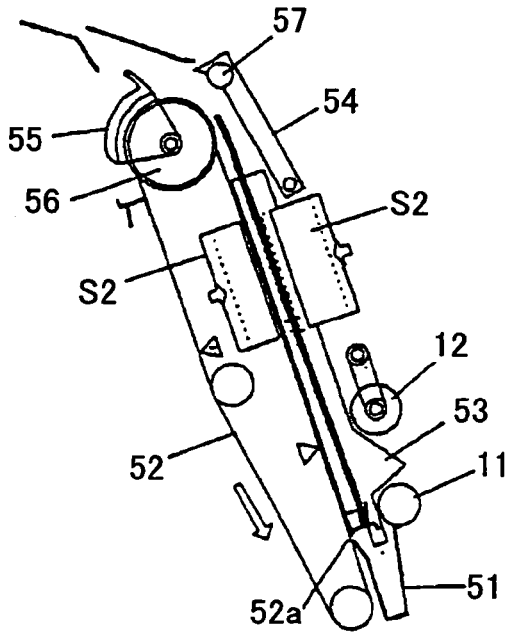
FIG. 6 is a view showing a state of a sheet stack which is stacked at the staple process tray and bound at the center in a center binding bookbinding mode.

As shown in FIG. 4, the control system includes a control unit 350 implemented as a microcomputer including a CPU (Central Processing Unit) 360 and an I/O (Input/Output) interface 370. The outputs of various switches arranged on a control panel, not shown, mounted on the image forming device PR are input to the control unit 350 via the I/O interface 370. Also input to the control unit 350 via the I/O interface 370 are the output of the inlet sensor 301, the output of an upper discharge sensor 302, the output of a shift discharge sensor 303, the output of a pre-stack sensor 304, the output of a staple discharge sensor 305, the output of a sheet sensor 310, the output of the belt home position sensor 311, the sheet stack arrival sensor 321, the folding position pass sensor 323, the movable rear fence home position sensor, and the output of the sheet surface sensors 330.

The CPU 360 controls, based on the above various inputs, the tray motor assigned to the shift tray 202, the guide plate motor assigned to open or close the guide plate, the shift motor assigned to move the shift tray 202, a knock roller motor assigned to drive the knock roller 12, solenoids including a return roller motor solenoid SOL 170 assigned to drive a return roller 13, a motor assigned to various rollers for conveyance, a discharge motor assigned to drive various discharge rollers, the discharge motor assigned to the discharge belt 52, the stapler motor assigned to move the edge binding stapler S1, a tilt motor assigned to rotate the edge binding stapler S1 obliquely, a jogger motor assigned to move the jogger fence 53, the steer motor assigned to rotate the guide plate 54 and movable guide 55, a conveyance motor assigned to drive conveying rollers that convey a sheet stack, a rear fence motor assigned to move the movable rear fence 73, the fold plate motor 166 assigned to move the fold plate 74, a fold roller motor assigned to drive the fold roller 81, and other motors and solenoids. The pulse signals of a staple conveyance motor, not shown, that drives the staple discharge rollers are input to the CPU 360 and counted thereby. The CPU 360 controls the knock solenoid 170 and jogger motor 158 in accordance with the number of pulses counted. The fold roller motor is made by a stepping motor and directly controlled from the CPU 360 via the motor driver or indirectly controlled via the I/O 370 and the motor driver.

Also, the CPU 360 causes the punch unit 100 to operate by controlling a clutch or a motor.

The CPU 360 controls the sheet post-process device PD in accordance with a program stored in a ROM (Read Only Memory), not shown, by using a RAM (Random Access Memory) as a work area.

3. Operations

Specific operations of the sheet post-process device to be executed by the CPU 360 in various modes available with the illustrative embodiment are described next.

3.1 Operation Corresponding to a Process Mode

In this embodiment, the following discharge operation is implemented corresponding to the post-process mode.

① Non-Staple Mode a:

The sheet is delivered from the path A to the path B by the rollers 3 and 4 so as to be discharged to the upper tray 201.

② Non-Staple Mode b:

The sheet is delivered from the path A to the path C by the roller 5 and a shift discharge roller 6 formed by the rollers 6*a* and 6*b* so as to be discharged to the shift tray 202.

③ Sort/Stack Mode:

The sheets are sequentially delivered from the path A to the shift tray 202 via the path C. The shift tray 202 is shifted perpendicularly to the direction of sheet discharge copy by copy in order to sort the sheets.

④ Staple Mode:

The sheet is conveyed from the path A to the staple process tray F via the path D, positioned and bound on the process tray F, and then discharged to the shift tray 202 via the path C.

⑤ Center-Binding Bookbinding Mode:

The sheets are sequentially conveyed from the path A to the process tray F via the path D, positioned and stapled at the center on the tray F, center folded on the fold tray G, and then discharged to the lower tray 203 via the path H.

Among the above described five modes, the center-binding bookbinding mode is particularly related to the present invention and is explained next in more detail. Explanation of the other modes is omitted. Folding roller couple 81 of the center folding process tray G, a folding plate 74, and upper and lower folding roller guides 501 and 502, respectively, form the sheet folding device of the present invention.

Figure 7:
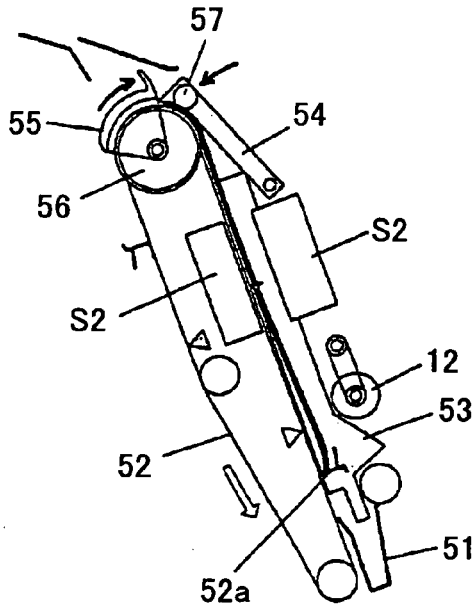
FIG. 7 is a view showing an initial condition wherein the sheet stack bound at the center in the center binding bookbinding mode is steered by the steering mechanism.

3.2 Center-Binding Bookbinding Mode:

In this mode, the sheets are sequentially conveyed from the path A to the staple tray F via the path D, positioned, stacked, and stapled at the center on the tray F, folded on the fold tray G, and then driven out to the lower tray 203 via the path H. In this mode, the path selectors 15 and 16 both are rotated counterclockwise to unblock the route extending from the path A to the path D. Also, the guide plate 54 and movable guide 55 are closed, as shown in FIG. 7, guiding the stapled sheet stack to the fold tray G so that center folding is performed.

Figure 13A:
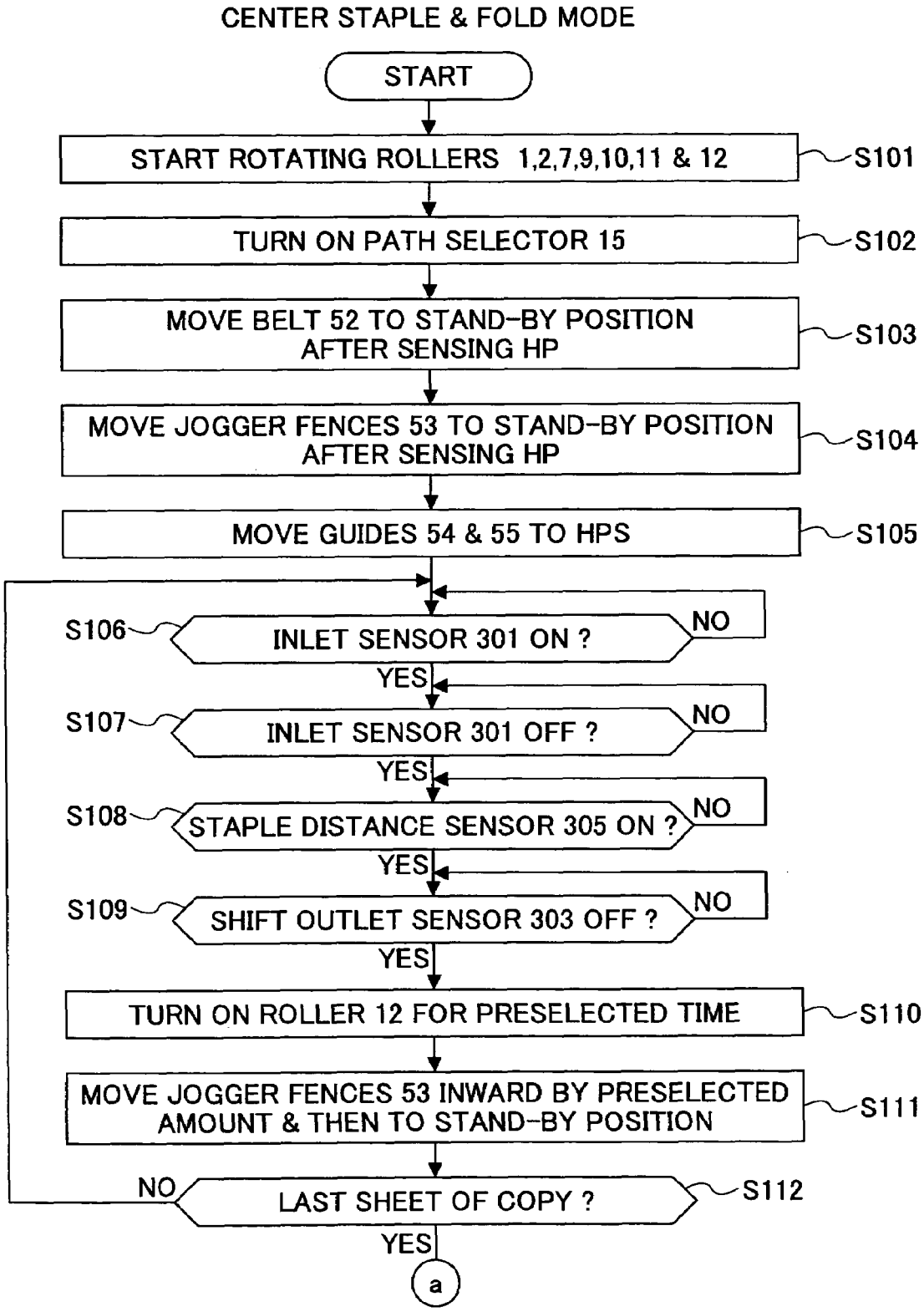
FIG. 13 is a flow chart showing process steps of a center binding bookbinding mode.
Figure 13B:
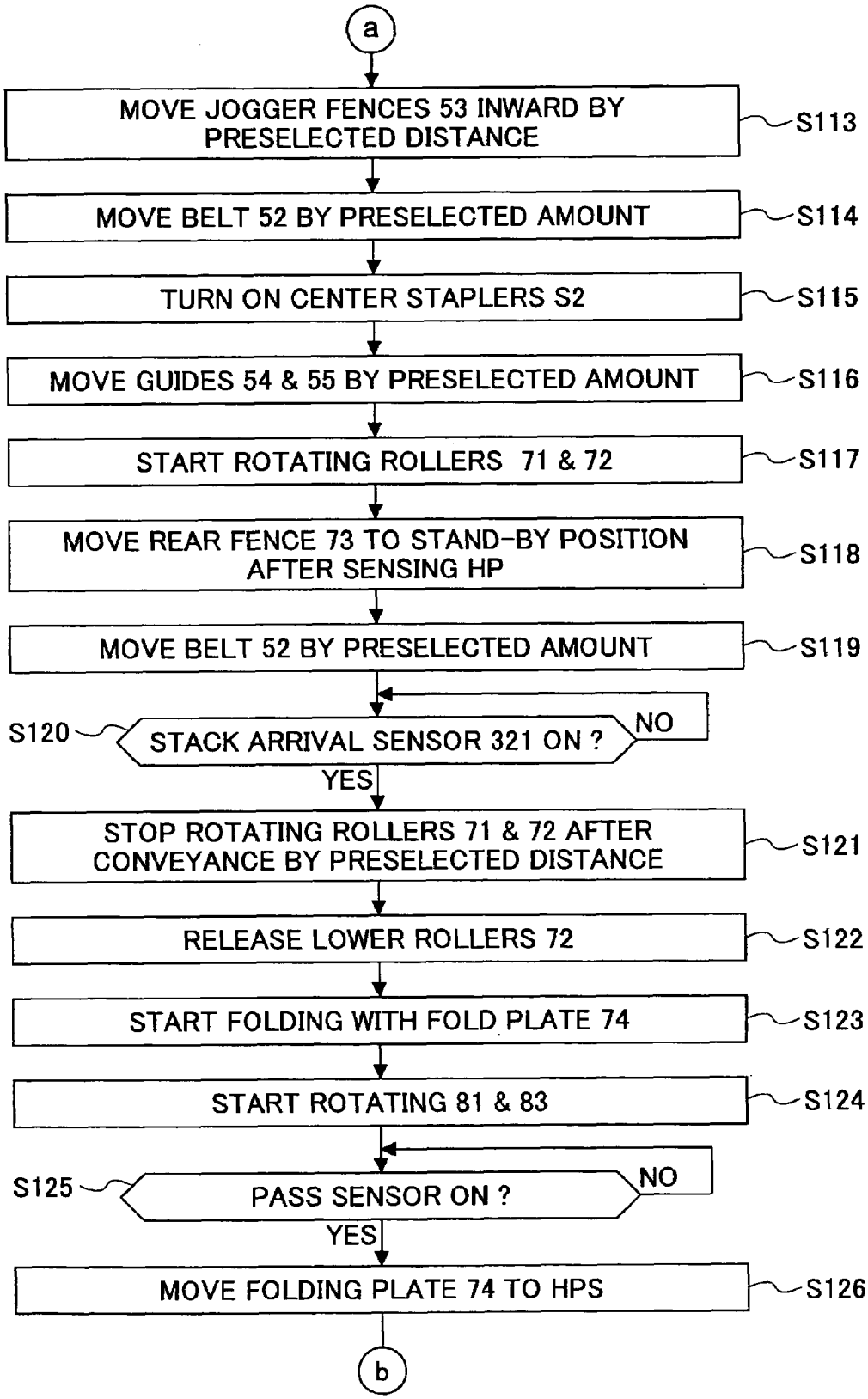
Figure 13C:
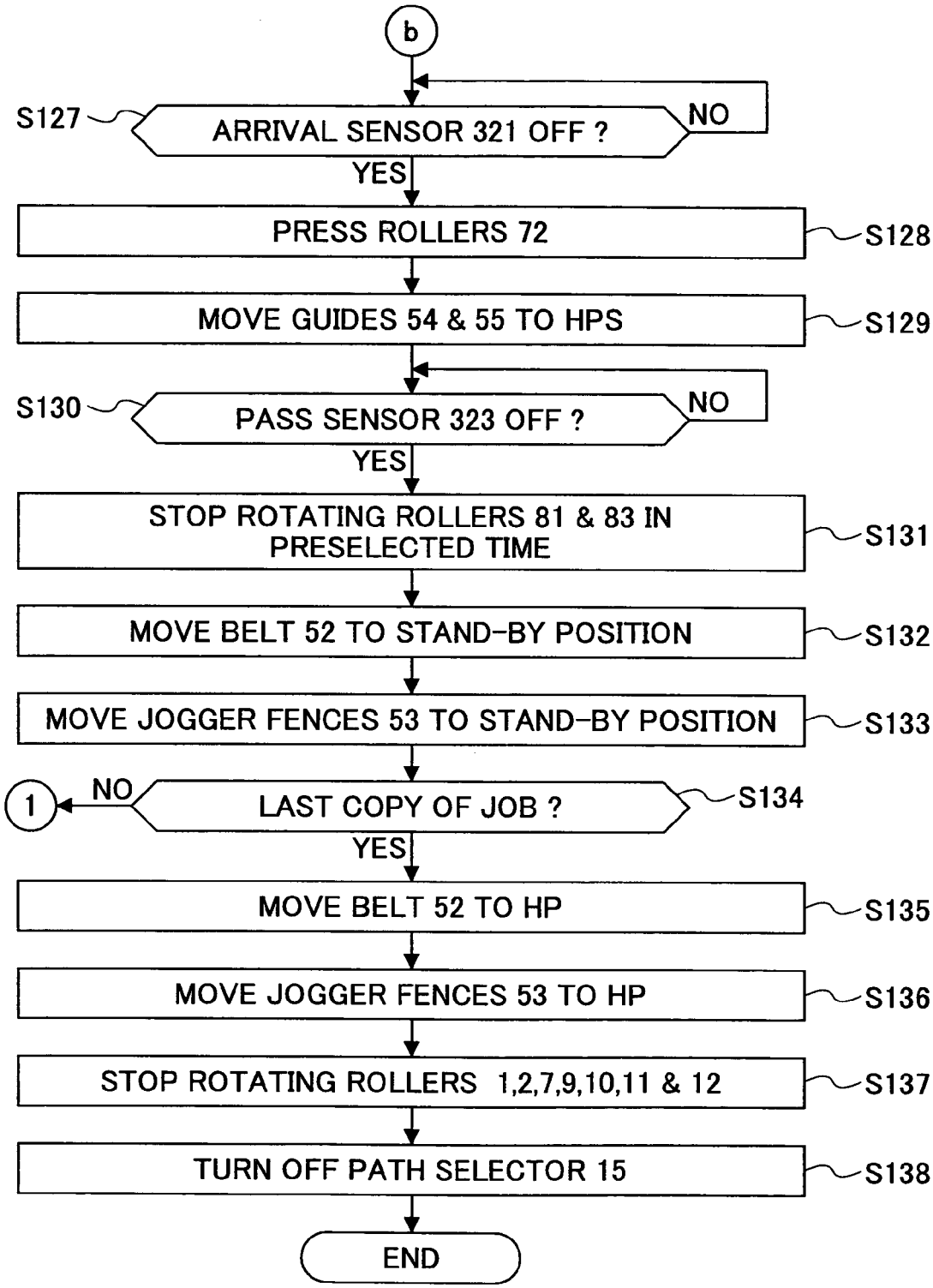

As shown in a flow chart of FIG. 13, before a sheet driven out of the image forming device PR enters the post-treatment device PD, the CPU 360 causes the inlet roller pair 1 and conveyor roller pair 2 on the path A, the conveyor roller pairs 7, 9 and 10 and staple outlet roller 11 on the path D and knock roller 12 to start rotating (step S101). The CPU 360 then turns on the solenoid assigned to the path selector 15 (step S102) to thereby cause the path selector 15 to rotate counterclockwise.

Subsequently, after the belt home position sensor 311 has sensed the belt 52 at the home position, the CPU 360 drives the discharge motor to move the belt 52 to the stand-by position (step S103) Also, after the jogger fence home position sensor has sensed each jogger fences 53 at the home position, the CPU 360 moves the jogger fence 53 to the stand-by position (step S104). Further, the CPU 360 moves the guide plate 54 and movable guide 55 to their home positions (step S105).

If the inlet sensor 301 has turned on (YES, step S106) and then turned off (YES, step S107), if the staple discharge sensor 305 has turned on (YES, step S108) and if the shift outlet sensor 303 has turned on (YES, step S109), then the CPU 360 determines that a sheet is present on the staple tray. In this case, the CPU 360 energizes the knock solenoid 170 for the pre-selected period of time to cause the knock roller 12 to contact the sheet and force it against the rear fences 51, thereby positioning the trailing edge of the sheet (step S110). Subsequently, the CPU 360 drives the jogger motor 158 to move each jogger fence 53 inward by the pre-selected distance for thereby positioning the sheet in the direction of width and then returns the jogger fences 53 to the stand-by position (step S511). See FIG. 9.

The CPU 360 repeats the step S106 and successive steps with every sheet. When the last sheet of a copy arrives at the staple tray F (YES, step S112), the CPU 360 moves the jogger fences 53 inward to the position where they prevent the edges of the sheets from being dislocated (step S113). After the step S113, the CPU 360 turns on the discharge motor to thereby move the belt 52 by a pre-selected amount (step S114), so that the belt 52 lifts the sheet stack to a stapling position assigned to the center staplers S2. Subsequently, the CPU 360 turns on the center staplers S2 at the intermediate portion of the sheet stack for thereby stapling the sheet stack at the center (step S115). See FIG. 6. The CPU 360 then moves the guides 54 and 55 each by a pre-selected amount in order to form a path directed toward the fold tray G (step S116) and causes the upper and lower roller pairs 71 and 72 of the fold tray G to start rotating (step S117). As soon as the movable rear fence 73 of the fold tray G is sensed at the home position, the CPU 360 moves the fence 73 to a stand-by position (step S118). The fold tray G is then ready to receive the stapled sheet stack.

After the step S118, the CPU 360 further moves the belt 52 by a pre-selected amount so that the rear edge of the sheet stack is pushed up by a discharge hook 52*a* (step S119). The CPU 360 causes the discharge roller 56 and press roller 57 to nip the sheet stack and convey it to the fold tray G. See FIG. 7. The discharge roller 56 is provided to a driving shaft of the discharge belt 52 and thereby driven in synchronization with the discharge belt 52. When the leading edge of the stapled sheet stack arrives at the position of the stack arrival sensor 321 and is conveyed by a pre-selected distance from the position of the folding roller couple 81 (step S120), the CPU 360 causes the upper and lower roller pairs 71 and 72 to stop rotating (step S121). That is, the sheet stack moves from the home position to a position corresponding to the sheet size so as to be conveyed to the movable rear fence 73 which stops at the stand-by position to set the position of the lower end of the sheet stack. At this time, the discharge hook 52*a* stops at a position 52*a*' where the discharge hook 52*a*, situated on an external circumference of the discharge belt 52, arrives in the vicinity of the rear edge fence 51. The guide plate 54 and the movable guide 55 return to the home positions so as to prepare for the next sheet. After causing the upper and lower roller pairs 71 and 72 to stop rotating, the CPU 360 then releases the lower rollers 72 from each other (step S122—FIG. 9) so as to separate.

Subsequently, the CPU 360 causes the fold plate 74 to start folding the sheet stack (step S123) and causes the fold roller pairs 81 and 82 and lower outlet roller pair 83 to start rotating. The vicinity of the part of the sheet stack bounded by staples is pushed with force from a direction substantially perpendicular to the sheet stack by the folding plate 74 so that the sheet stack is folded by the folding plate 74 and pushed into the nip of the folding rollers 81 (step S124—FIG. 10). The folding rollers 81 rotated in advance push the folded sheet stack with pressure at the nip and fold a center part of the sheet stack by conveying the sheet stack.

When the rear edge of the sheet stack is detected by the folding part pass sensor 323 (step S125), the folding plate 74 returns to its home position (step S126). If the stack arrival sensor 321 is made to turn off (step S127), pressure by the lower rollers 72 is reinstituted (step S128) so as to prepare for the next sheet stack. In addition, if the next job is for sheets of the same size, the movable rear edge fence 73 may wait at its current position.

The CPU 360 moves the guide plate 54 and the movable guide 55 to their home positions (step S129). The CPU 360 then determines whether the folded sheet stack has moved away from the pass sensor 323 (step S130). If the answer at the step S130 is YES, then the CPU 360 causes the fold roller pairs 81 and 82 and lower outlet roller pair 83 to further rotate over a pre-selected period of time and then stop (step S131). The CPU 360 causes the belt 52 and jogger fences 53 to return to the stand-by positions (steps S132 and S133). Subsequently, the CPU 360 determines whether the above sheet stack is the last copy of a single job (step S134). If the answer at step S134 is NO, then the procedure returns to the above-discussed steps. If the answer at the step S535 is YES, then the CPU 360 returns the belt 52 and jogger fences 53 to the home positions (steps S135 and S136). At the same time, the CPU 360 causes the inlet roller 1, the rollers 2, 7, 9, and 10, the staple discharge roller pair 11 and knock roller 12 to stop rotating (step S137) and turns off the solenoid assigned to the path selector 15 (step S138) As a result, all the structural parts are returned to their initial positions and the process is finished.

Thus, the sheet stack conveyed from the image forming device is center-bound at the staple process tray F and center-folded at the center-folded process tray G. And then the sheet stack which is center folded is discharged on the lower tray 203 so as to be loaded.

Figure 8:
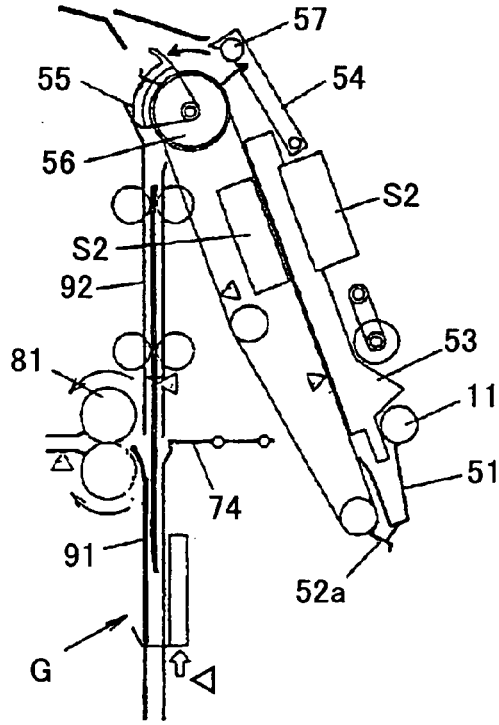
FIG. 8 is a view showing a condition wherein the sheet stack bound at the center and steered by the steering mechanism is brought to the center fold process tray.
Figure 9:
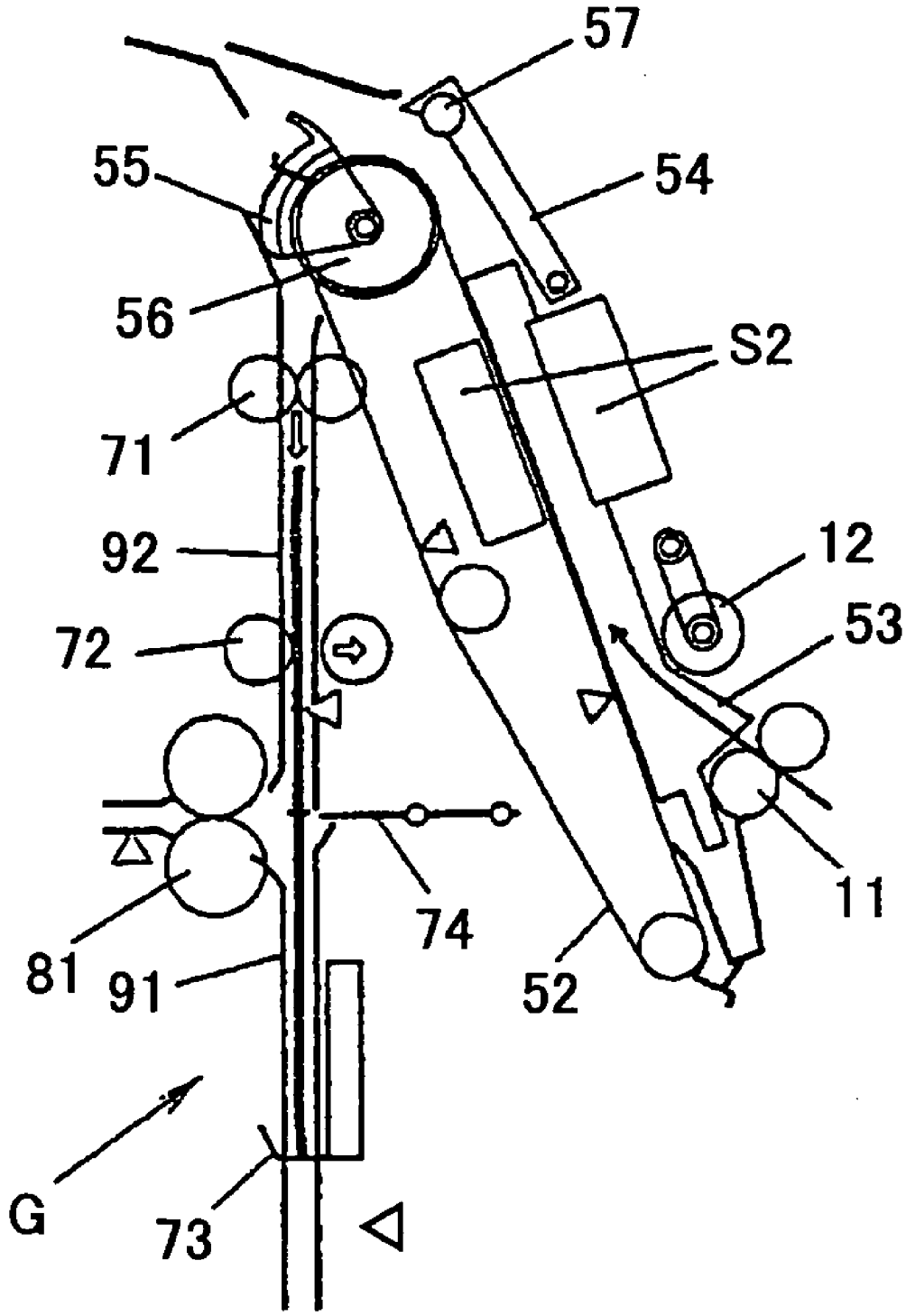
FIG. 9 is a view showing a condition in which the sheet stack is positioned at a center folding position of the center folding process tray in the center binding bookbinding mode.
Figure 10:
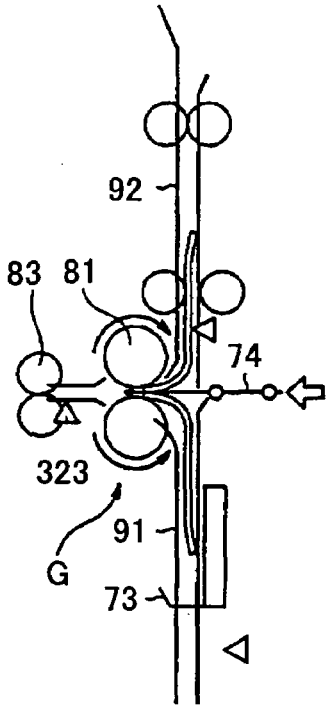
FIG. 10 is a view showing a condition in which the sheet stack is started to be folded at the center of the center fold process tray by operating the center fold plate in the center binding bookbinding mode.
Figure 12:
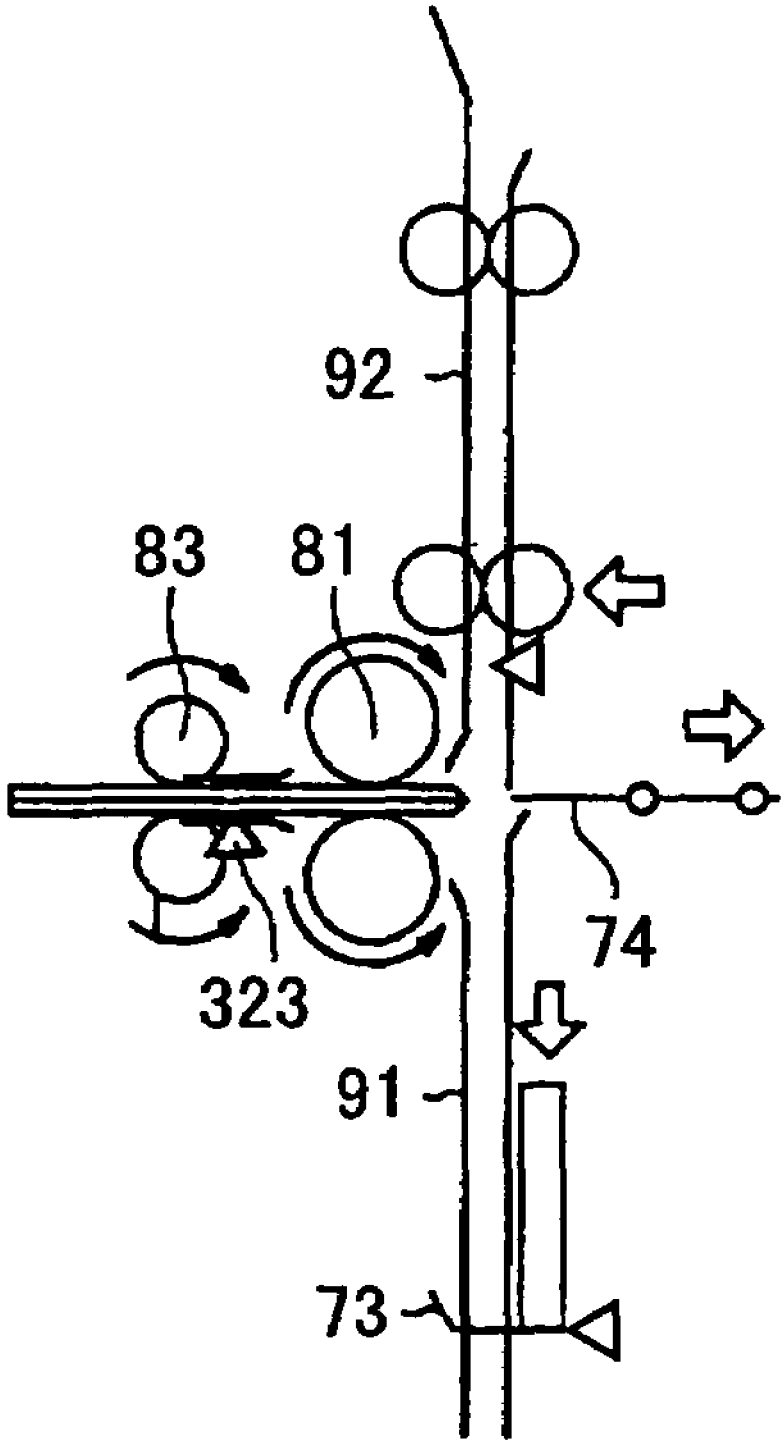
FIG. 12 is a view showing a condition in which the sheet stack is discharged after being folded at the center of the center fold process tray by operating the center fold plate in the center binding bookbinding mode.

As shown in FIG. 3, the upper and lower folding roller guides 501 and 502 are provided in this embodiment. FIG. 8 shows a state where the sheet stack is conveyed. FIG. 10 and FIG. 12 show a state where a center of the sheet stack is folded by the folding plate 74 and pushed into the folding roller nip, and then conveyed and discharged by the folding rollers 81.

At this time, the upper folding roller guide 501 is pushed by the moving sheet stack so as to bend to a configuration along an external configuration of the corresponding folding roller 81*a*. As a result of this, the upper folding roller guide 501 has the same configuration as the lower folding roller guide 502. Since the folding rollers 81 expose substantially the same amount at upper and lower sides, there is no difference in a conveying amount of the folding rollers 81 at the upper and lower sides due to a difference of the exposure amount of the folding rollers 81. Accordingly, it is possible to fold at a precise position.

Figure 15:
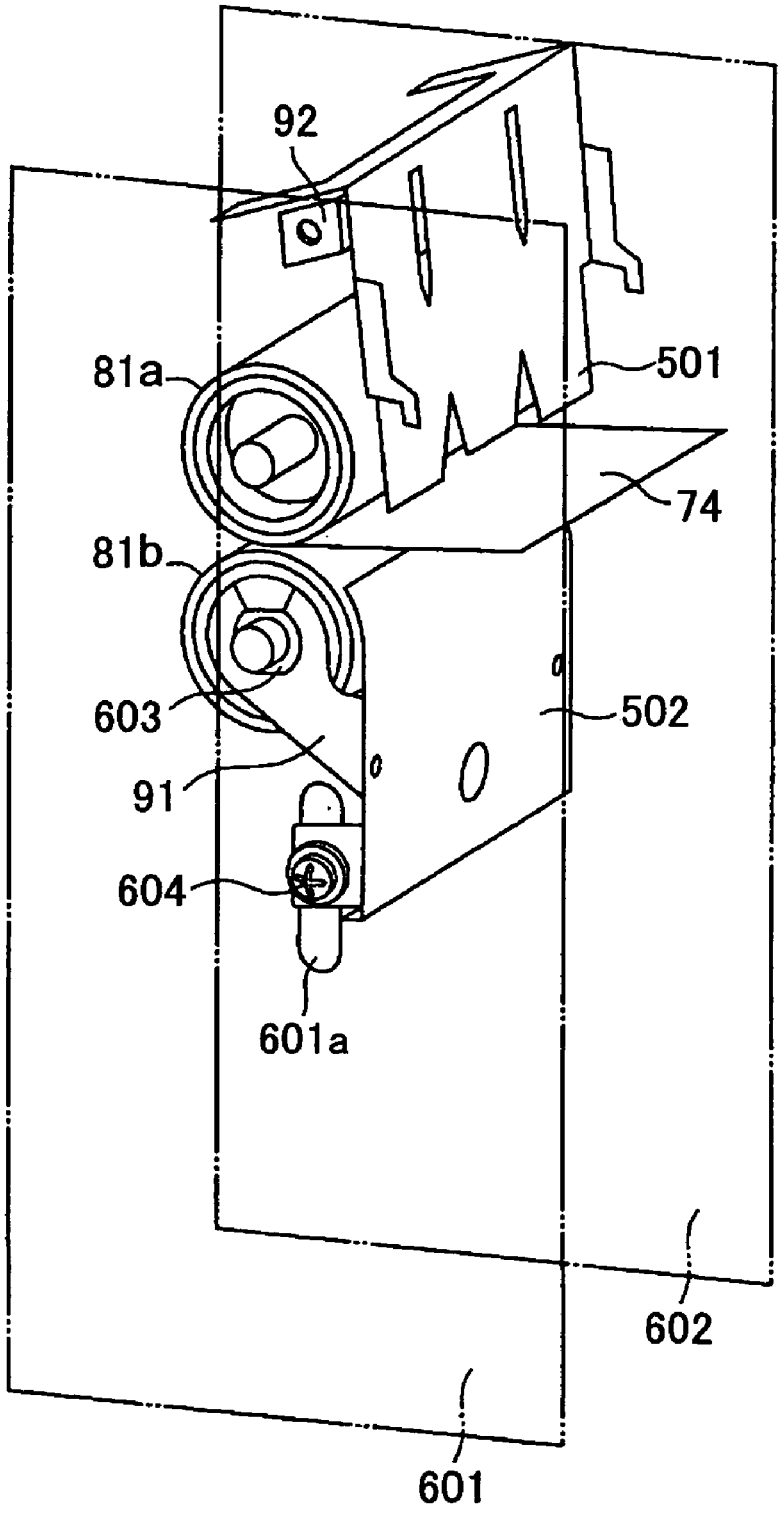
FIG. 15 is a view showing a relationship of the upper and lower folding roller guides, the folding roller couple, and the folding plate; and an installation structure of the folding roller guide.

FIG. 15 is a perspective view of a main part showing a relationship of the upper and lower folding roller guides 501 and 502 and a folding roller couple 81. The upper folding roller guide 501 situated at an upper stream side in the conveying direction is made of a relatively soft material having elasticity such as PET (polyethylene terephthalate) sheet. The upper folding roller guide 501 extends along the conveying direction at the time of no load, as shown in FIG. 8 and FIG. 15. The lower folding roller guide 502 situated at the downstream side in the conveying direction is made of a relatively hard material having elasticity such as a thin plate of stainless. The lower folding roller guide 502 is formed so as to have an external configuration conforming to the corresponding roller 81*b*. The free end of the first guide member projects into the conveying path more than the free end of the second guide member projects. Hence, it is possible to convey the sheet or the sheet stack without the lower folding roller guide 502 being an obstacle.

Figure 14:
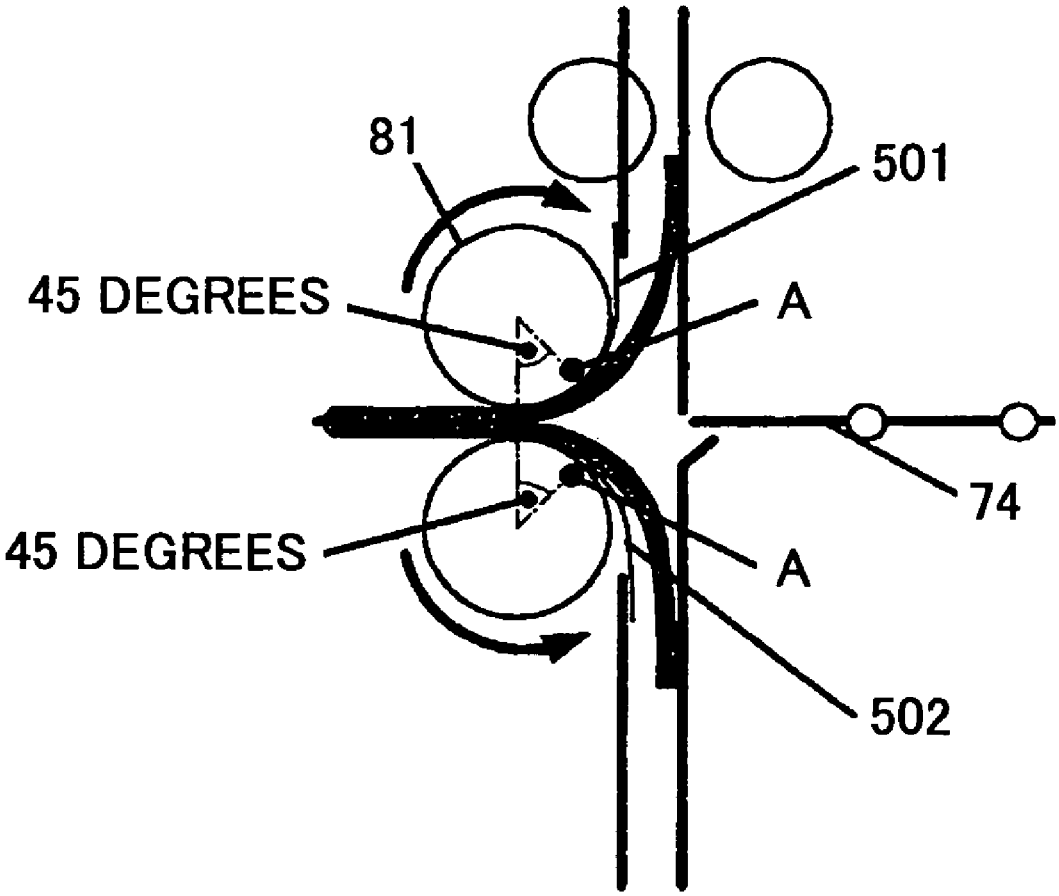
FIG. 14 is a view showing a relationship of upper and lower folding roller guides, a folding roller couple, and the sheet stack.

The upper and lower folding roller guides 501 and 502, particularly the upper folding roller guide 501, are bent to conform to the external configuration of the folding rollers 81 while guiding the sheet, when pushing the sheet is being pushed into the folding roller couple 81 by the folding plate 74. At this time, free ends of the upper folding roller guide 501 and the lower folding roller guide 502 are positioned so as to prevent pressure-welding by the folding rollers 81, which corresponds to a stiffness force of the sheet or the sheet stack, at the time when the sheet or the sheet stack is pushed into the nip of the folding rollers 81 by the folding plate 74. For example, in the above mentioned embodiment, as shown in FIG. 14, the positions of the free ends A of the roller guides 501 and 502 are situated at a position 45 and more degrees away far from the nip of the folding roller couple 81 in the direction of an upper stream side of the sheet conveying path at the time of folding. That is, the dimensions of the roller guides 501 and 502 are set so as to situate at a positions being 45 and more degrees away far from the nip of the folding roller couple 81 in the direction of an upper stream side of the sheet conveying path at the time of folding.

FIG. 14 shows a relationship of upper and lower folding roller guides 501 and 502, the folding roller couple 81, and the sheet stack. FIG. 15 shows a relationship of the upper and lower folding roller guides 501 and 502, the folding roller couple 81, and the folding plate 74, and an installation structure of the folding roller guides 501 and 502.

The closer the head ends of the folding roller guides 501 and 502 are to the nip, the more the folding roller guides 501 and 502 function as guides. If the number of the sheets to which folding is applied is small, the above mentioned structure may be acceptable. However, if the number of the sheets to which folding is applied is large, since the folding rollers 81 re moved so that the folding roller guides 501 and 502 relatively project, the folding roller guides 501 and 502 may exceed the point at which space may start being generated between the sheet stack while being center-folded and the folding rollers 81. Hence, the folding roller guides 501 and 502 are set to be far from the nip by the amount of their projections in advance so as to prevent their function as guides from declining. Under the structure regarding positions of the head ends of the folding roller guides 501 and 502, the folding roller guides 501 and 502 may be prevented from exceeding the point at which space may be generated between the sheet stack while being center-folded and the folding rollers 81. Therefore, it is possible to avoid making the device large like the conventional art and achieve space-saving, low cost and high productivity.

Furthermore, the folding rollers 81 are made of a material where the coefficient of friction against a material having good smoothness such as PET sheet or steel plate is lower than the coefficient of friction against the sheet stack. For example, a silicon group rubber is suitable as the above material. In a case where such a silicon group rubber material is used, if the coefficient of friction against the sheet is set as 1, the coefficient of friction against the PET sheet or steel plate may be in a range of 0.4 to 0.6.

The point at which space may start being generated between the sheet stack while being center-folded and the folding rollers 81 is the positions A shown in FIG. 14, which is 45 degrees away far from the nip. The head ends of the folding roller guides 501 and 502 are positioned so as to be separated from the positions A.

Figure 16:
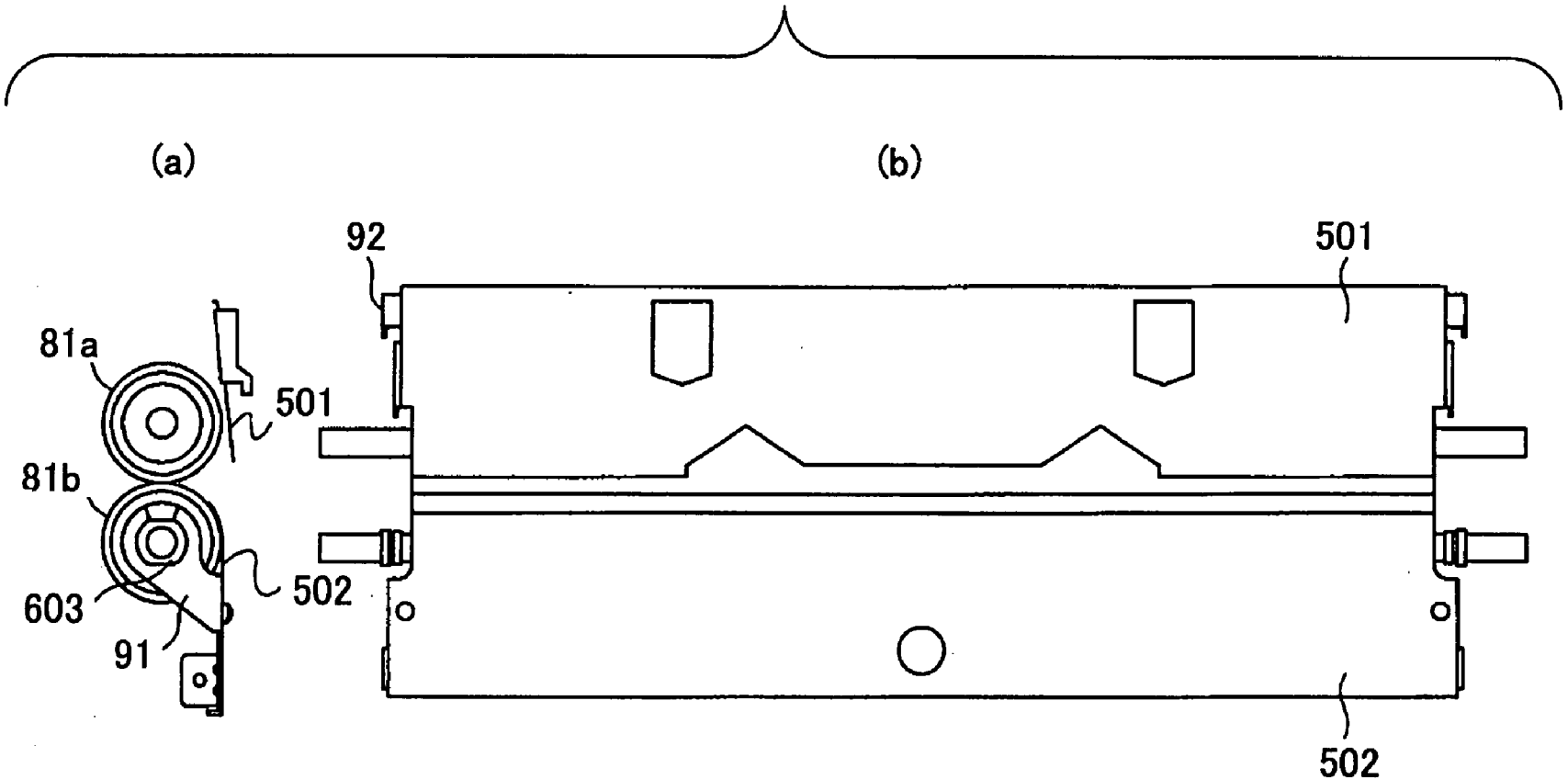
FIG. 16 a front view and a side view showing a relationship between the upper and lower folding roller guides and the folding roller couple.

Furthermore, the structure of the folding roller guides 501 and 502, which changes in a body with the folding roller couple 81, is shown in FIG. 15 and FIG. 16. That is, the lower guide plate 91 rotatably supports both ends of a shaft of the folding roller 81*b* by a bearing 603, and is changeably supported via an elongated hole forming part 601*a* of a front frame 601, as well as rear frame 602, by a screw 604 having a step. The lower folding roller guide 502 is provided at the lower guide plate 91.

In this embodiment, only the folding roller 81*b* situated at the lower side is changeably supported. However, only the folding roller 81*a* situated at the upper side or both the folding rollers 81*a* and 81*b* may be changeably supported. In addition, it is efficient that the above discussed structure be applied to both the upper and lower sides if both the folding rollers 81*a* and 81*b* are changeably supported. It is also efficient that the above discussed structure be applied to either of the both upper and lower sides that are changeably supported.

The upper and lower folding roller guides 501 and 502 basically do not deform during the sheet is conveyed, but do deform when the sheet or the sheet stack is folded. At this time, as shown in FIG. 14, FIG. 15 and FIG. 16, when the sheet or the sheet stack is folded, since the lower folding roller guides 502 is curved in advance so as to conform to the external configuration of the folding roller 81*b*, the lower folding roller guides 502 deforms only microscopically. However, the upper roller guide 501 deforms from a state where the upper roller guide 501 is parallel to the path formed by the lower and upper guide plates 91 and 92 so as to conform (curve) to the configuration of the folding roller 81*a*. Accordingly, PET film having a thickness of approximately between 0.1 and 0.25 mm is used for the upper roller guide 501 and a stainless belt of plate spring having a thickness of approximately between 0.1 and 0.25 mm is used for the lower roller guide 502. Therefore, the upper roller guide 501 is made of a material having an elastic material softer than a material for the lower roller guide 502. Here, FIG. 16-(*a*) is a front view showing a relationship between the upper and lower folding roller guides 501 and 502 and the folding roller couple 81. FIG. 16-(*b*) is a side view showing the relationship between the upper, and lower folding roller guides 501 and 502 and the folding roller couple 81.

A state where the sheet stack is conveyed is shown in FIG. 8. Since it is sufficient that a force necessary for guiding the head end of the sheet stack be micro (very small), even if the upper roller guide 501 is made of a relatively soft elastic sheet such as PET sheet, the upper roller guide 501 functions sufficiently. In addition, since the lower roller guide 502 is made of a relatively hard material having elasticity such as a thin plate of stainless and provided at the downstream side in the conveying direction so as to conform to the external configuration of the folding roller 81*b*, it is possible to position the head end of the sheet stack precisely.

Figure 11:
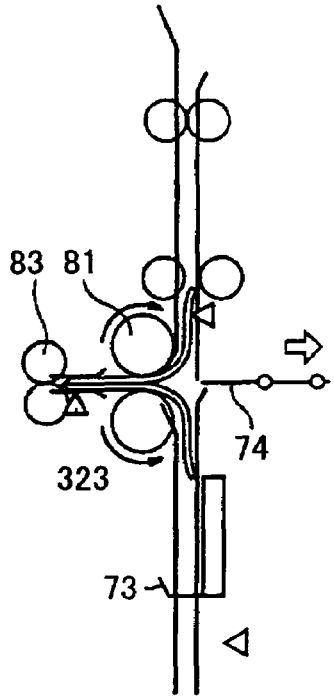
FIG. 11 is a view showing a condition in which the sheet stack is folded by the second step fold roller after the sheet stack is started to be folded at the center of the center fold process tray by operating the center fold plate in the center binding bookbinding mode.

Furthermore, a state where the center of the sheet stack is folded by the folded plate 74 and pushed into the folding roller nip, and then conveyed and discharged by the folding rollers 81 is shown in FIG. 10, FIG. 11 and FIG. 12. At this time, the upper roller guide 501 is pushed by the moving sheet stack and bent by a weak reaction force so as to conform to the external configuration of the folding roller 81*a*. As result of this, the upper roller guide 501 has a configuration the same as the lower roller guide 502 and the substantially same amounts of the rollers 81 are exposed at the upper and lower sides. Hence, no difference in the amount of conveying between the upper and lower sides due to the difference of the exposure amount is generated so that it is possible to fold at a precise position.

Under the above discussed function, the conveying path and the folding roller couple 81 are set apart by the thickness of the elastic sheet. Hence, the head end of the folding plate 74 while being out and the nip of the folding rollers 81 can be positioned closer than in the conventional art. Because of this, it is possible to make a folding structure in a minimum space so that a moving structure is not necessary and only minimum cost is incurred. In addition, since it is possible to shorten the moving distance of the folding plate 74, it is possible to achieve an improvement of productivity.

Furthermore, as shown in FIG. 14, the point at which space may start being generated between the sheet stack while being center-folded and the folding rollers 81 is the positions A shown in FIG. 14, which is 45 degrees away far from the nip. The head ends of the folding roller guides 501 and 502 are positioned so as to be separated from the positions A. Hence, the folding roller guides 501 and 502 are not put between the sheet stack and the folding roller couple 81 and an overload on the driving source of the folding roller couple 81 does not occur. Therefore, it is not necessary to use a large capacity driving source of the folding roller couple 81 and thereby cost-saving can be accomplished.

In addition, since the folding roller guide 502 or 501 moves in a body with the folding roller 81*a* or 81*b*, it is possible to stably support the head end parts of the folding roller guides 502 and 501 in the vicinity of the positions A shown in FIG. 14 which is 45 degrees away from the nip. Therefore, the folding roller guides 502 and 501 function sufficiently as a sheet conveying guide and thereby it is possible to stably operate center-binding bookbinding regardless of the number of sheets to be folded.

The present invention is not limited to these embodiments, but variations and modifications may be made without departing from the scope of the present invention.

This patent application is based on Japanese Priority Patent Application No. 2003-168395 filed on Jun. 12, 2003, the entire contents of which are hereby incorporated by reference.

What is claimed is:

1. A sheet folding device, comprising:

a folding plate configured to urge a sheet or a sheet stack in a direction pre-set against a conveying path;

two folding rollers configured to receive the sheet and to urge the sheet into a nip therebetween;

a guide including at least a first guide member and a second guide member configured to guide the sheet or the sheet stack to prevent the sheet from contacting the two folding rollers along the conveying path where the sheet or the sheet stack is conveyed, the first guide member deforming so that a free end of the first guide member approaches one of the two folding rollers, the first guide member is provided at a upper stream side with respect to the conveying path, the second guide member is provided at a down stream side with respect to the conveying path, and a free end of the first guide member projects into a side of the conveying path more than a free end of the second guide member, wherein the sheet or the sheet stack is folded while being put between and conveyed by the two folding rollers, wherein the free end of the second guide member adapts in share to a contour at a side of the corresponding folding roller, and wherein the second guide member is formed of a harder material than the first guide member.

2. The sheet folding device as claimed in claim 1, wherein each of the first guide member and the second guide member is formed of a material having a different elasticity.

3. The sheet folding device as claimed in claim 2, wherein the first guide member is formed of a material less rigid than a material of the second guide member.

4. The sheet folding device as claimed in claim 2, wherein a free end of the first guide member and a free end of the second guide member are positioned to prevent pressure-welding by the folding rollers caused by a stiffness force of the sheet or the sheet stack at the time when the sheet or the sheet stack is urged into the nip of the folding rollers by the folding plate.

5. The sheet folding device as claimed in claim 1, wherein the two folding rollers are moved corresponding to entry into the nip of the sheet stack.

6. The sheet folding device as claimed in claim 1, wherein the folding rollers are formed of a material having a coefficient of friction which is lower with respect to the guide as compared to the sheet or sheet stack.

7. The sheet folding device as claimed in claim 1, wherein the first guide member is positioned such that the sheet or the sheet stack is in continuous contact with one of the two folding rollers during a folding operation up to a first continuous contact point that is at least 45 degrees away from the nip in a first direction; and the second guide member is positioned such that the sheet or the sheet stack is in continuous contact with the other of the two folding rollers during the folding operation up to a second continuous contact point that is at least 45 degrees away from the nip in a second direction opposite the first.

8. The sheet folding device as claimed in claim 7, wherein the first guide member is positioned such that the first guide member is not in contact with first continuous contact point during the folding operation and the second guide member is positioned such that the second guide member is not in contact with second continuous contact point during the folding operation.

9. The sheet folding device as claimed in claim 1, further comprising a process part configured to apply a designated process to the sheet or sheet stack.

10. The sheet folding device as claimed in claim 1, further comprising an image forming device for forming an image on a recording medium.

* * * * *